US007111429B1

(12) United States Patent
Sutton

(10) Patent No.: US 7,111,429 B1
(45) Date of Patent: Sep. 26, 2006

(54) COMBINATION SLEEVE AND PROTECTOR FOR CUT FLOWER BOUQUETS

(76) Inventor: Elliot Sutton, Fantasy Farms 2761 NW. 82nd Ave., Miami, FL (US) 33122-1041

( * ) Notice: Subject to any disclaimer, the term of this patent is extended or adjusted under 35 U.S.C. 154(b) by 0 days.

(21) Appl. No.: 11/079,571

(22) Filed: Mar. 15, 2005

(51) Int. Cl.
*A01G 5/02* (2006.01)

(52) U.S. Cl. ..... 47/41.01

(58) Field of Classification Search ..... 47/41.01, 47/29.7, 29.6, 30, 72; 206/423; 220/690; 428/23, 27

See application file for complete search history.

(56) References Cited

U.S. PATENT DOCUMENTS

| | | | | | |
|---|---|---|---|---|---|
| 1,520,647 | A * | 12/1924 | Hennegan | 47/72 |
| 5,106,662 | A * | 4/1992 | Khayat | 428/23 |
| 5,522,202 | A * | 6/1996 | Weder et al. | 53/397 |
| 6,018,908 | A * | 2/2000 | Charrin et al. | 47/41.01 |
| 6,499,251 | B1 * | 12/2002 | Weder | 47/72 |
| 6,868,636 | B1 * | 3/2005 | Weder et al. | 47/72 |

* cited by examiner

*Primary Examiner*—T. Nguyen
(74) *Attorney, Agent, or Firm*—Robert J. Van Der Wall

(57) ABSTRACT

Disclosed is a combination flower protector and variable diameter display sleeve for cut flower bouquets that is fabricated from a single sheet of flexible planar plastic or other material that is adapted to be rolled about the stems of a bouquet of cut flowers, preferably roses. The apparatus is comprised of a pie shaped segment in which are disposed a pair of elongated parallel slots that extend to near the left side of the sheet while at the right edge is disposed a tab structure. The tab structure may be inserted into the elongated slots to hold the cone together but also to allow its upper diameter to be varied in amount commensurate with the length of the slots. The effect is that varying the diameter of the apparatus allows it to function first as a flower protector when the bouquet is tightly compressed within the apparatus in its small diameter configuration, and to function second as a tapered display sleeve when the apparatus is in its large diameter configuration to allow the flowers to be attractively displayed apart from each other. Near to the lower edge of the apparatus are disposed a series of co-linear slots that are parallel to the lower edge and have a slot width greater than the elongated parallel slots to accommodate conventional flower stem bundling and tying elements such as rubber bands to cooperate and retain in position these elements.

4 Claims, 2 Drawing Sheets

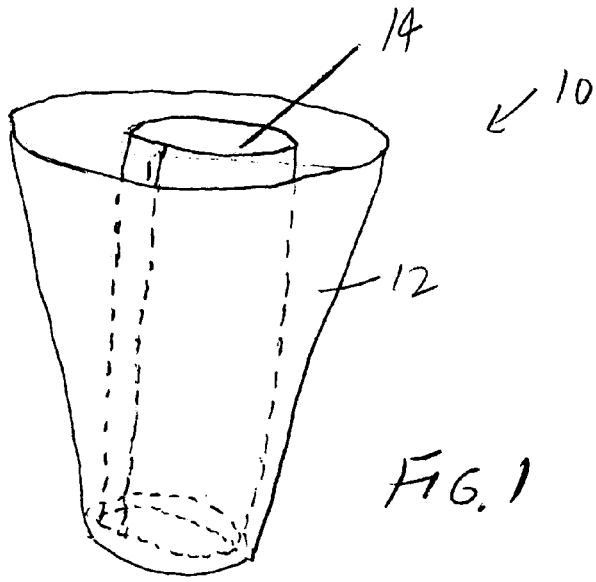
FIG. 1
PRIOR ART
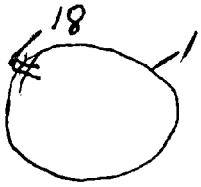
FIG. 2
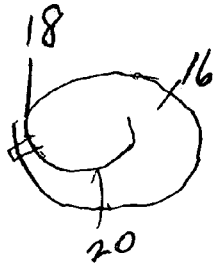
FIG. 3
FIG. 4
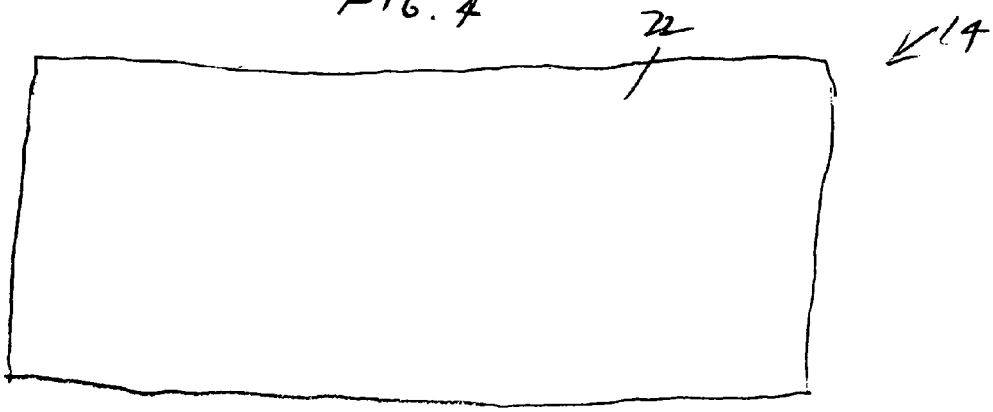

COMBINATION SLEEVE AND PROTECTOR FOR CUT FLOWER BOUQUETS

BACKGROUND OF THE INVENTION

1. Field of the Invention

The present invention relates generally to the field of floral presentation and protection. More specifically, the present invention relates to a single device that combines functions separated into two (2) structures in the prior art. The first function is the protection of cut flowers, especially roses, that have been arranged into bouquets prior to shipment using a flexible planar member wrapped around them. The member is preferably PVC of about 0.003–0.005 inches thick or cardboard, usually corrugated cardboard. The second function is a sleeve formed into a truncated cone. The sleeve being typically also made of plastic sheeting and having a thickness of 0.0015–0.002 inches. The sleeve is conventionally seen about bouquets of flowers that have been placed in buckets of water and are displayed at supermarkets. By the time they are so displayed, the prior art separate protector has normally been removed to allow the bouquet to spread out more and display more favorably. The separate prior art flower protector wraps around the bouquets rather tightly to protect them from bruising and other injuries while in transit to point of sale displays such as at supermarkets.

2. Description of the Prior Art

As was noted above, in the prior art the functions of protection and display sleeves involved separate structures. The prior art protector is a rectangular strip that is wrapped around the stems of the flowers beneath the flower itself and then attached to itself typically by being stapled. The protector may spiral into the internal portion of the stems by wrapping a portion of the bouquet stems into the protector first and then adding more stems until the protector encompasses all of the stems. When the rectangular strip reaches around far enough to enclose all of the stems, it is then stapled to itself after being pulled tightly. After being enclosed in the protector, the flowers are disposed within a tapered sleeve of fixed diameters, the sleeve being a truncated cone through the lower opening of which the stems project so they can be retained in water.

SUMMARY OF THE INVENTION

Bearing in mind the foregoing, it is a principal object of the present invention to combine the functions of a cut flower bouquet protector with a cut flower bouquet display sleeve.

It is a related object of invention to achieve economies in combining the functions of a flower protector with a flower display sleeve in a single structure.

Another object of the invention is to create in a single structure a display sleeve having a variable diameter in contrast to the fixed diameters truncated cone display sleeves of the prior art.

A further object of the invention is to provide in a single structure for a tightly wrapped configuration for protection of cut flower bouquets during shipment and a loose expanded enclosure as a sleeve for use in point of sale displays such as in supermarkets.

An additional object for the invention is to employ a pair of elongated parallel slots that are substantially horizontal when wrapped around a vertical bouquet in combination with a tab structure having tab ears which project from the side of the sheet material from which the combination protector and sleeve is made, the tab ears having a root at the same relative height in the sheeting as the elongated parallel slots such that the tab ears can project into and fill the slots to allow for expansion and contraction of the combination protector sleeve, thereby allowing a variable diameter for the first time in a display sleeve.

One more object of the invention is to provide a series of co-linear short slots to accommodate and hold in position conventional flower stem bundling and tying elements such as rubber bands that are placed around the bottom of the stems to retain them and the bouquet together.

Other objects and advantages will be apparent to those skilled in the art upon review of the following descriptions and the appended drawings.

In accordance with a principal aspect of the present invention there is provided an apparatus that is a combination flower protector and variable diameter display sleeve for cut flower bouquets that is fabricated from a single sheet of flexible planar material that is adapted to be rolled about the stems of a bouquet of cut flowers, preferably roses. The planar plastic material is preferably PVC plastic sheeting having an approximate thickness of 0.010 inches, or cardboard, usually corrugated cardboard.

When laid out flat, the sheeting material is die cut into a pie shaped segment in which the upper edge is a portion of a circle and the lower edge is also a portion of a circle of a smaller diameter than top surface. From a point by the vertical center of this pie shaped segment and about two-thirds of the length of the bottom edge to the top edge are die cut a pair of elongated parallel slots that extend to near the left side of the sheet but which do not intercept the left side of the sheet. At the same distance from the lower surface at the right side, the right edge is interrupted by a tab structure with upper and lower tab ears, the root of which tab ears are the same distance apart as the elongated slots are from each other. Near to the lower edge the sheet are cut a series of co-linear slots that are parallel to the lower edge and have a slot width greater than the elongated parallel slots to accommodate conventional flower stem bundling and tying elements such as rubber bands to cooperate and retain in position these elements. The sheet material of the present invention when thusly die cut is adapted to rolled into a truncated cone wherein tab ears may be inserted into the elongated slots to hold the cone together but also to allow its upper diameter to be varied in amount commensurate with the length of the slots.

Various other features of the invention will become apparent to those skilled in the art from the following detailed description taken in conjunction with the appended drawings, in which:

BRIEF DESCRIPTION OF DRAWINGS

FIG. 1 is a perspective view of the two part prior art showing the fixed diameters tapered display sleeve around a flower protector.

FIG. 2 is an end view of one method of use of the prior art flower protector showing one which is simply used to surround the flowers and is stapled.

FIG. 3 is an alternative embodiment of the prior art flower protector which includes a tail portion that is partially wrapped into the center of the bouquet before surrounding all the bouquet stems and then also being stapled.

FIG. 4 is a top plan view of the flower prior art protector before it is wrapped about the stems of the flowers and stapled.

DETAILED DESCRIPTION OF THE PREFERRED EMBODIMENTS

Figure 5:
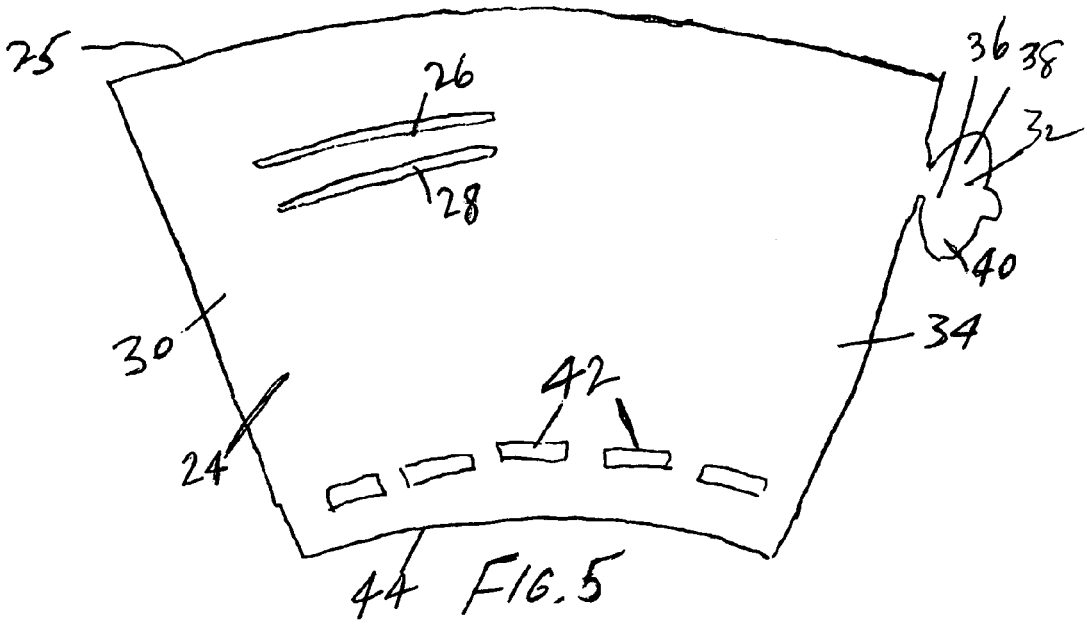
FIG. 5 is a plan view of the preferred embodiment of the present invention following die cutting and before being rolled into a truncated cone for use as the combination flower protector and display sleeve.

As required, detailed embodiments of a present invention are displayed herein; however it is to be understood that the disclosed embodiments are nearly exemplary of the invention which may be embodied in various forms. Therefore specific structural and functional details disclosed therein are not to be interpreted as limiting, but merely as a basis for the claims and as a representative basis for teaching one skilled in the art to employ the present invention in virtually any appropriately detailed structure.

Reference is now made to the drawings, wherein like characteristics and features are the present invention shown in various figures are designated by the same reference numerals.

FIG. 1 shows the prior art two part assembly 10 having a tapered fixed diameters truncated cone display sleeve 12 and a cylindrical flower protector 14 disposed within the tapered display sleeve 12.

FIG. 2 shows the prior art flower protector 14 in an end view comprised of a single sheet 16 which is intended to be wrapped tightly around flower stems and then stapled at 18.

FIG. 3 is also an end view of the prior art flower protector simply comprised of a single sheet 16 which is stapled at 18 which has a tail portion 20 that is rolled into the center of the bouquet.

FIG. 4 is a top plan view of the unrolled prior art flower protector 14 showing that it was simply a rectangular portion of a flexible planar material 22, that may be PVC or other plastic or cardboard.

FIG. 5 shows the present invention in a planar configuration after it has been die cut from sheeting 24 into a pie shaped segment in which the upper edge 25 is a portion of a circle and the lower edge 44 is also a portion of a circle of a much smaller diameter than top surface. From a point by the vertical center of this pie shaped segment and about two-thirds of the length of the bottom edge 44 to the top edge 25 are die cut a pair of elongated parallel slots 26 and 28 that extend to near the left side 30 of the sheet 24 but which do not intercept the left side 30 of the sheet 24. At the same distance from the lower edge 44 at the right side 34 of the sheet 24, the right edge is interrupted by a tab structure 32 with upper 38 and lower 40 tab ears, the root 36 of which tab ears 38 and 40 are the same distance apart as the elongated slots 26 and 28 are from each other. Near to the lower edge 44 of the sheet 24 are die cut a series of co-linear slots 42 that are parallel to the lower edge 44 and have a slot width greater than the elongated parallel slots 26 and 28 to accommodate conventional flower stem bundling and tying elements such as rubber bands to cooperate and retain in position these flower stem bundling and tying elements. The sheet material 24 of the present invention when thusly die cut is adapted to be rolled into a truncated cone wherein tab ears 38 and 40 may be inserted into the elongated parallel slots 26 and 28 to hold the cone together but also to allow its upper diameter to be varied in amount commensurate with the length of the slots 26 and 28. The combination of the tab structure 32 and the elongated parallel slots 26 and 28 allow the diameter of the truncated cone to be varied from an open position for display of the flowers at a point of sale down to a substantially cylindrical structure for use as a flower protector during shipment of flowers.

Figure 6:
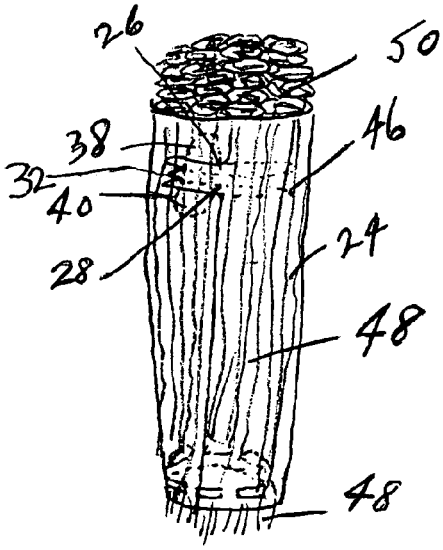
FIG. 6 is a perspective view of the preferred embodiment of the invention being formed into a cylinder and wrapped tightly around a bouquet of flowers for protection in shipment. This figure also illustrates the lower co-linear slots for use with conventional flower stem bundling and tying elements such as rubber bands.

FIG. 6 shows the sheet material 24 formed into substantially cylindrical flower protector 46 wrapped around flower stems 48 and tightly compressed bouquet of flowers 50. This is achieved by having tab ears 38 and 40 of tab structure 32 near the left end of elongated parallel slots 26 and 28.

Figure 7:
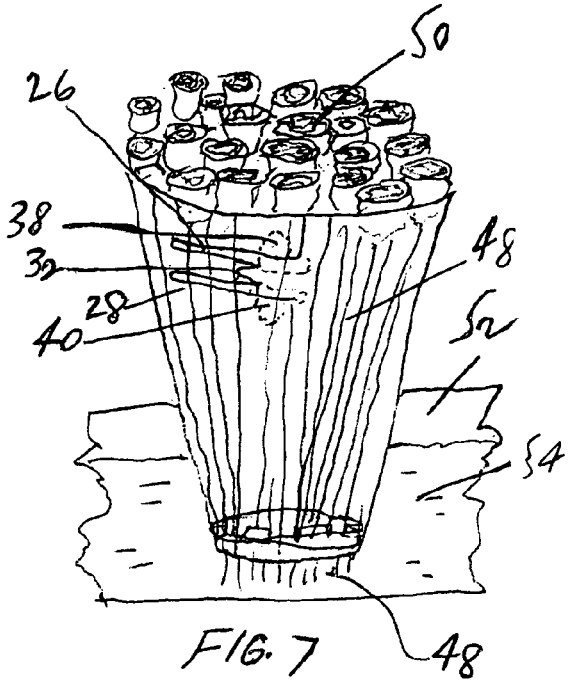
FIG. 7 is a perspective view of the present invention in which the diameter of the combination protective member and display sleeve is increased to maximize the display advantage of the bouquet at point of sale locations such as in supermarkets.

Turning finally to FIG. 7, a bouquet of flowers 50 is set into a bucket 52 containing water 54 which hydrates stems 48 at the display point of sale. But the tab structure 32 with tab ears 38 and 40 are inserted into elongated parallel slots 26 and 28 near the right side thereof so that the flowers in bouquet 50 are attractively displayed apart from each other.

While the invention has been described, disclosed, illustrated and shown in various terms for certain embodiments for modifications which it has assumed in practice, the scope of the invention is not intended to be, nor should it be deemed to be, limited thereby and such other modifications or embodiments as may be suggested by the teachings therein are particularly reserved especially as they fall within the breadth and scope of the claims here appended.

What is claimed is:

1. A sleeve apparatus rolled about a bouquet of flowers comprising:

a planar flexible sheet having a first side, a second side opposites of the first side, a top edge, and a lower edge opposites of the top edge, wherein the planar flexible sheet is served as both a flower protector and point of sale display sleeve;

a pair of substantially horizontal elongated parallel slots in the sheet disposed near the first side and the top edge of the sheet; and a tab structure disposed near the top edge and on a peripheral of the second side of the sheet which includes tab ears wherein the tab ears are inserted into both the elongated parallel slots at the same time such that when the tab ears are disposed at one end of the slots the apparatus is in a first diameter diameter configuration serves as the flower protector when the bouquet is tightly compressed and when the tab ears are at opposite end of the slots the apparatus is in a second diameter configuration, which is larger than the first diameter configuration, serves as the point of sale display sleeve to allow the flowers to be attractively displayed apart from each other the apparatus being sized such that flower stems project beneath the apparatus from an open bottom so that the flower stems can be hydrated with water when the apparatus is in its large diameter configuration at a point of sale display; and a plurality of co-liner slots, wherein the co-linear slots are shorter in length than the elongated parallel slots, disposed parallel to and near the lower edge of the sheet to cooperate with flower stem bundling and tying elements such as rubber bands that are placed around of the stems.

2. The apparatus of claim 1 in which each slot near the lower edge has a slot width greater than the elongated parallel slots to accommodate conventional flower stem bundling and tying elements such as rubber bands to cooperate and retain in position these elements.

3. The apparatus of claim 1 in which the sheeting is preferably comprised of PVC.

4. The apparatus of claim 1 in which the sheeting is preferably comprised of cardboard.

* * * * *